US010471496B2

(12) United States Patent
Simonin et al.

(10) Patent No.: US 10,471,496 B2
(45) Date of Patent: Nov. 12, 2019

(54) INDEXING SELF-ALIGNING HARDWARE TOOL

(71) Applicant: GM GLOBAL TECHNOLOGY OPERATIONS LLC, Detroit, MI (US)

(72) Inventors: Matthew P. Simonin, Ortonville, MI (US); Robert N. Saje, Shelby Township, MI (US); Bhavesh Shah, Troy, MI (US); Kevin Stang, Farmington Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 509 days.

(21) Appl. No.: 15/235,625

(22) Filed: Aug. 12, 2016

(65) Prior Publication Data

US 2018/0043421 A1 Feb. 15, 2018

(51) Int. Cl.
*B21J 15/44* (2006.01)
*B21D 39/03* (2006.01)
(Continued)

(52) U.S. Cl.
CPC ..... *B21J 15/44* (2013.01); *B21D 22/22* (2013.01); *B21D 24/04* (2013.01); *B21D 39/031* (2013.01);
(Continued)

(58) Field of Classification Search
CPC .... B21D 43/003; B21D 28/04; B21D 28/265; B21D 43/26; B21D 43/023; B21D 43/02;
(Continued)

(56) References Cited

U.S. PATENT DOCUMENTS 2,600,834 A * 6/1952 Blair ..... B21D 28/06 83/40
3,197,996 A * 8/1965 Zeder, Jr. ..... B21D 22/02 72/348
(Continued)

FOREIGN PATENT DOCUMENTS

CN 103237648 A 8/2013
CN 103240879 A 8/2013
(Continued)

OTHER PUBLICATIONS

Simufact Simulation of Joining Processes; brochure courtesy of Eckold GmbH & Co. KG.*
(Continued)

*Primary Examiner* — Monica S Carter
*Assistant Examiner* — Mahdi H Nejad
(74) *Attorney, Agent, or Firm* — Quinn IP Law

(57) ABSTRACT

The indexing self-aligning hardware tool can join components and includes a first tool section including a die carrier, one or more dies coupled to the die carrier, and a first locator coupled to the die carrier. The indexing self-aligning hardware tool also includes a second tool section having a support body, one or more blankholders coupled to the support body, one or more punches movably disposed inside the blankholders, and a second locator coupled to the support body. The first locator and the second locator are configured to mate with a product feature locator of a component to align the first tool section relative to the second tool section.

16 Claims, 1 Drawing Sheet

(51) Int. Cl.

| | |
|---|---|
| ***B21D 24/04*** | (2006.01) |
| ***B21D 22/22*** | (2006.01) |
| ***B21J 15/02*** | (2006.01) |
| ***B21J 15/10*** | (2006.01) |
| *B21D 22/06* | (2006.01) |

(52) U.S. Cl.
CPC ..... *B21J 15/025* (2013.01); *B21J 15/10* (2013.01); *B21D 22/06* (2013.01)

(58) Field of Classification Search
CPC ..... B21D 43/06; B21D 22/22; B21D 37/12; B21D 37/14; B21D 24/04; B21D 37/08; B21D 39/031; B21J 15/025
USPC ... 72/347, 349, 343, 380, 708, 354.2, 466.9; 29/235–238, 243.5–243.55
See application file for complete search history.

(56) References Cited

U.S. PATENT DOCUMENTS

| | | | | | |
|---|---|---|---|---|---|
| 3,673,901 | A * | 7/1972 | Vinson | B21D 28/04 | 83/14 |
| 4,325,173 | A * | 4/1982 | Kirii | A44B 19/42 | 219/243 |
| 4,326,402 | A * | 4/1982 | Wallis | B21D 37/08 | 72/420 |
| 4,397,171 | A * | 8/1983 | Suh | B21D 53/28 | 72/348 |
| 5,526,668 | A * | 6/1996 | Futamura | B21D 43/05 | 29/33 Q |
| 5,699,946 | A * | 12/1997 | Hashimoto | B26F 1/3846 | 225/1 |
| 5,722,139 | A * | 3/1998 | Ladouceur | B23P 19/062 | 29/243.518 |
| 7,587,825 | B2 * | 9/2009 | Coleman | B21D 53/265 | 29/894.3 |
| 9,044,801 | B2 * | 6/2015 | Golovashchenko | B21D 22/06 | |
| 9,782,815 | B2 * | 10/2017 | Sallade | B21D 19/08 | |
| 2002/0095969 | A1 * | 7/2002 | Matsunaga | B21D 22/02 | 72/350 |
| 2008/0098789 | A1 * | 5/2008 | Hori | B21D 22/02 | 72/349 |
| 2010/0186475 | A1 * | 7/2010 | Hirotani | B21D 22/22 | 72/349 |
| 2013/0273312 | A1 * | 10/2013 | Campbell | B32B 7/08 | 428/137 |
| 2016/0101459 | A1 * | 4/2016 | Scott | B62D 65/02 | 428/594 |
| 2016/0271678 | A1 * | 9/2016 | Yoshimoto | B21D 43/04 | |

FOREIGN PATENT DOCUMENTS

| | | | |
|---|---|---|---|
| CN | 104399859 | A | 3/2015 |
| JP | H11198194 | A | 7/1999 |
| JP | 2013039673 | A | 2/2013 |

OTHER PUBLICATIONS

Quality of self-piercing riveting (SPR) joints from cross-sectional perspective; Elsevier; Available online Jul. 14, 2017.*
Self-piercing riveting connections using aluminium rivets; Elsevier; Available online Oct. 13, 2009.*

* cited by examiner

INDEXING SELF-ALIGNING HARDWARE TOOL

TECHNICAL FIELD

The present disclosure relates to an indexing self-aligning hardware tool for joining components together.

BACKGROUND

In manufacturing or repair processes, it is sometimes useful to join to components together or parts. Several joining methods have been developed to join components. For example, two components may be welded. Joining tools have also been developed to aid in joining components together.

SUMMARY

Large and heavy C-shaped tools are sometimes used to join large components. Manipulating these large and heavy C-shaped tools can be challenging. For this reason, it is desirable to develop a versatile and light-weight tool that can be used with large components and eliminate the need for these large and heavy C-shaped tools. To this end, the present disclosure describes an indexing self-aligning hardware tool for joining components. The indexing self-aligning hardware tool includes a first tool section including a die carrier, one or more dies coupled to the die carrier, and a first locator coupled to the die carrier. The indexing self-aligning hardware tool also includes a second tool section having a support body, one or more blankholders coupled to the support body, one or more punches movably disposed inside the blankholders, and a second locator coupled to the support body. The first locator and the second locator are configured to mate with a product feature locator of a component to align the first tool section relative to the second tool section. The present disclosure also relates to a locating assembly including the indexing self-aligning hardware tool.

The above features and advantages and other features and advantages of the present teachings are readily apparent from the following detailed description of the best modes for carrying out the teachings when taken in connection with the accompanying drawings.

DETAILED DESCRIPTION

Figure 1:
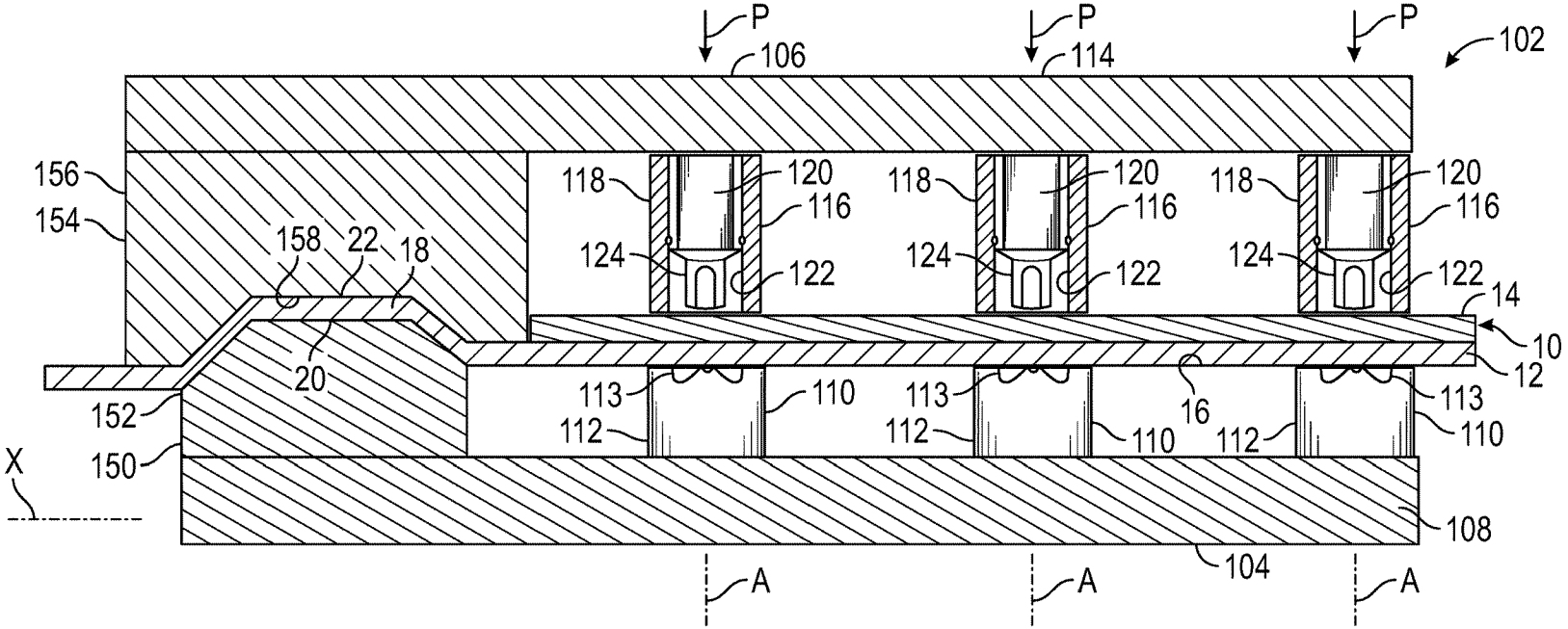
FIG. 1 is a schematic, sectional side view of a locating assembly including an indexing self-aligning hardware tool.
Figure 2:
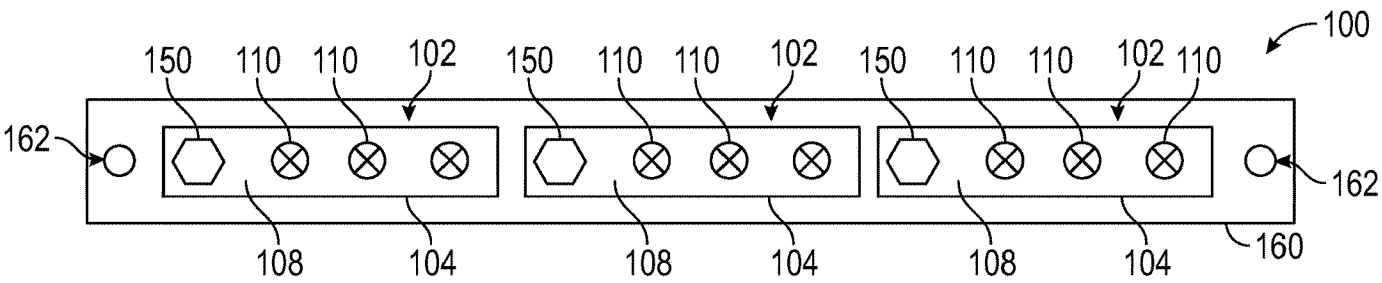
FIG. 2 is a schematic, top view of the locating assembly shown in FIG. 1.

Referring to the drawings, wherein like reference numbers correspond to like or similar components throughout the several figures, FIGS. 1 and 2 schematically illustrate an indexing self-aligning hardware tool 102 for joining two or more components 10 (e.g., panels) without the need of a heavy and large C-shaped tool. To this end, the indexing self-aligning hardware tool 102 includes a first tool section 104 and a second tool section 106. The first tool section 104 and the second tool section 106 may be wholly or partly made of a substantially rigid material, such as a metallic material. The second tool section 106 is not coupled to the first tool section 104, thereby allowing the indexing self-aligning hardware tool 102 to be easily positioned around two or more components 10. The first tool section 104 is only indirectly coupled to the second tool section 106 only when the two components 10 are pressed between the first tool section 104 and the second tool section 106. As such, the first tool section 104 and/or the second tool section 106 can be easily moved relative to each other to surround the components 10.

With reference to FIG. 1, the first tool section 104 includes a die carrier 108 and one or more dies 110 supported by the die carrier 108. As non-limiting example, the die carrier 108 can move (e.g., slide) along a longitudinal axis X to align the first tool section 104 with respect to the second tool section 106. Thus, the first tool section 104 can move relative to the second tool section 106. Each die 110 includes a die body 112 and a die recess 113 formed on the die body 112. In the depicted embodiment, the die body 112 is directly coupled to the die carrier 108 to enhance the structural integrity of the first tool section 104. Further, in the depicted embodiment, the first tool section 104 includes three dies 110. However, the first tool section 104 may include more or fewer dies 110. The first tool section 104 further includes a first locator 150 coupled to the die carrier 108. The first locator 150 can help locate the first tool section 104 relative to the second tool section 106 as discussed below. In the depicted embodiment, the first locator 150 includes a locating protrusion 152 directly extending from the die carrier 108. The locating protrusion 152 may have a hexagonal cross-sectional shape to minimize slippage once the first tool section 104 is properly aligned with the second tool section 106. The locating protrusion 152 may also have a lateral polygonal shape to minimize slippage once the first tool section 104 is properly aligned with the second tool section 106.

With continued reference to FIG. 1, the second tool section 106 includes a support body 114, such as an end effector or a fixture tooling, and one or more punching assemblies 116 supported by the support body 114. In the depicted embodiment, the second tool section 106 includes three punching assemblies 116. However, the second tool section 106 may include more or fewer punching assemblies 116. Each punching assembly 116 includes a blankholder 118 and a punch 120 movably disposed in the blankholder 118. The support body 114 may be directly coupled to the blankholder 118 to enhance the structural integrity of the second tool section 106. The blankholder 118 may be substantially cylindrical in order to accommodate the punch 120 while minimizing the space occupied in the indexing self-aligning hardware tool 102. Irrespective of its shape, the blankholder 118 defines an interior cavity 122 configured, shaped, and sized to receive the punch 120. In addition to the blankholder 118, the punch assembly 116 includes a fastener 124 movably disposed inside the blankholder 118. Accordingly, the interior cavity 122 of the blankholder 118 is configured, shaped, and sized to also receive the fastener 124.

The support body 114 can move relative to the die carrier 108 and may be an actuation device that, upon actuation, drives the punch 120 in a direction indicated by arrows P toward the first tool section 104. As a consequence, the punch 120 is configured to drive the fastener 124 in the direction indicated by arrows P toward the components 10. As a non-limiting example, the fastener 124 may be a self-piercing rivet to avoid the need to predrill a hole in the components 10. The second tool section 106 includes a second locator 154 coupled to the support body 114. The second locator 154 can help locate the first tool section 104 relative to the second tool section 106. In the depicted embodiment, the second locator 154 includes a locating body 156 directly coupled to the support body 114. The second locator 154 defines a locating recess 158 formed in the locating body 156. The locating recess 158 and the locating protrusion 152 have substantially mating shapes (i.e., mirror shapes) in order to help align the first tool section 104 with the second tool section 106.

With reference to FIG. 1, the components 10 can be clamped against the first tool section 104 and the tool section 106 during operation. In the depicted embodiment, the components 10 include a first component 12 and a second component 14. The first component 12 and the second component 14 may be wholly or partly made of a substantially rigid material, such as a metallic material. The second component 14 is configured, shaped, and sized to the disposed on (and in direct contact with) the first component 12. Accordingly, in the depicted embodiment, the second component 14 has a substantially planar shape to allow it to be disposed on and in direct contact with the first component 12. The first component 12 may also have a substantially planar portion 16 to facilitate contact and abutment with the second component 14. In addition to the substantially planar portion 16, the first component 12 has a product feature locator 18 coupled to the substantially planar portion 16 of the first component 12.

The product feature locator 18 is configured, shaped, and sized to mate with the first locator 150 and the second locator 154 to align the first tool section 104 with the second tool section 106. To this end, the product feature locator 18 is not flat or planar. As a non-limiting example, the product feature locator 18 has a lateral polygonal shape configured, shaped, and sized to mate with the locating protrusion 152 and the locating recess 158. Specifically, the product feature locator 18 has a first locator surface 20 and a second locator surface 22 opposite the first locator surface 20. The first locator surface 20 is configured, shaped, and sized to directly contact and mate with the locating protrusion 152 to help index the first tool section 104 and the second tool section 106 with respect to the first component 12 and the second component 14. The second locator surface 22 is configured, shaped, and sized to directly contact and mate with the second locator 154 mates with the product feature locator 18. At this point, the product feature locator 18 is disposed in the locating recess 158 to help index the first tool section 104 and the second tool section 106 with respect to the first component 12 and the second component 14. Specifically, the second locator surface 22 is configured, shape, and sized to be received and mate with the locating recess 158. It is envisioned that the product feature locator 18 may be configured as pocket formations, holes, slots, welded brackets, clinch hardware, among others. Regardless of the configuration, the product feature locator 18 allows the size of the second tool section 106 to be minimized. Further, the product feature locator 18 allows the same second tool section 106 to be used for different components 10.

With reference to FIG. 2, the indexing self-aligning hardware tool 102 is part of a locating assembly 100. The locating assembly 100 further includes the components 10 (e.g., the first component 12 and second component 14) and an assembly fixture 160 supporting one or more die carriers 108. In the depicted embodiment, the assembly fixture 160 supports three die carriers 108, but it is envisioned that the assembly fixture 160 can support more or fewer die carriers 108. The assembly fixture 160 may be coupled to a movable platform, thereby allowing the first tool section 104 to move relative to the second tool section 106. The assembly fixture 160 may define one or more datum holes 162 for coupling components 10 adjoining the first component and the second component 14. As such, the product feature locator 18 can be used to components 10 adjoining the first component 12 and/or the second component 14 (i.e., employing a sub-datum strategy).

The indexing self-aligning hardware tool 102 can be used in a manufacturing or repair process. The manufacturing or repair process entails indexing (i.e., locating) the first tool section 104 relative to the first component 12 and the second component 14. To do so, the first tool section 104 is moved along the longitudinal axis X until the first locator 150 is substantially aligned with the product feature locator 18 of the first component 12. At this point, the first locator 150 may be mated with the product feature locator 18 by, for example, placing the product feature locator 18 on the locating protrusion 152. At this point, the first locator surface 20 of the product feature locator 18 may be in direct contact with the locating protrusion 152. The second component 14 is also disposed on and in direct contact with the first component 12. Then, the second tool section 106 is moved toward the first component 12 and the second component 14 until the product feature locator 18 is disposed in the locating recess 158. At this point, the second locator surface 22 of product feature locator 18 may be in direct contact with the second locator 154, and the punch assemblies 116 are aligned with the dies 110 along alignment axes A. The alignment axes A may be parallel to each other to speed up the process. Once the first tool section 104 and the second tool section 106 are properly aligned with each other and the product feature locator 18, the first component 12 and the second component 14 are clamped together between the dies 110 and the blankholders 118. The fasteners 124 are then driven through the first component 12 and the second component 14 and into the die recesses 113 of the dies 110 to join the first component 12 and the second component 14 together. During this process, the fastener 124 pierces the first component 12 and the second component 14 and shape of the die recess 113 causes the fastener 124 to flare within the second component 14 to form a mechanical interlock. To produce a relatively strong mechanical interlock, the punch assemblies 116 should be aligned with the dies 110 along the respective axes A. For this reason, it is desirable to incorporate the product locator 18 in the first component 10, the first locator 150 in the first tool section 104, and the second locator 154 in the second tool section 106.

While the best modes for carrying out the teachings have been described in detail, those familiar with the art to which this disclosure relates will recognize various alternative designs and embodiments for practicing the teachings within the scope of the appended claims. The indexing self-aligning hardware tool 102 and locating assembly 100 illustratively disclosed herein may be suitably practiced in the absence of any element which is not specifically disclosed herein. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings.

The invention claimed is:

1. An indexing self-aligning hardware tool, comprising:

a first tool section including a die carrier, a first die coupled to the die carrier, and a first locator coupled to the die carrier, wherein the first tool section includes a second die and a third die, the first locator is a locating protrusion extending directly from the die carrier, and the locating protrusion has a hexagonal cross-sectional shape to minimize slippage; and a second tool section including a support body, a blankholder directly coupled to the support body, the blankholder is in direct contact with the support body, a first punch movably disposed inside the blankholder, and a second locator coupled to the support body, the second locator is discrete and separate from the blankholder, wherein the first locator and the second locator are configured to mate with a product feature locator of a first component to align the first tool section relative to the second tool section, the first component has a planar portion to facilitate contact with a second component, the second locator includes a locating body directly coupled to the support body, the second locator defines a locating recess formed in the locating body, the second tool section includes a second punch and a third punch, the product feature locator is not flat, the product feature locator is directly coupled to the planar portion, the product feature locator is in direct contact with the locating protrusion, and the product feature locator is in direct contact with the locating body of the second locator; and a fastener disposed inside the blankholder, wherein the blankholder defines an interior cavity, the fastener is disposed inside the interior cavity of the blankholder, and the first punch is in direct contact with the fastener.

2. The indexing self-aligning hardware tool of claim 1, wherein the blankholder is sized to receive the fastener, the first punch is configured to drive the fastener toward the first die, and the fastener is a self-piercing rivet.

3. The indexing self-aligning hardware tool of claim 1, wherein the first tool section is movable relative to the second tool section.

4. The indexing self-aligning hardware tool of claim 1, further comprising an assembly fixture, wherein the die carrier is supported by the assembly fixture.

5. The indexing self-aligning hardware tool of claim 4, wherein the assembly fixture has a datum hole.

6. The indexing self-aligning hardware tool of claim 1, wherein the second locator defines a locating recess, and the locating recess and the locating protrusion have mating shapes.

7. The indexing self-aligning hardware tool of claim 6, wherein the product feature locator has a first locator surface and a second locator surface opposite the first locator surface, the locating recess is shaped to receive and mate with the first locator surface, the second locator surface defines a locator recess, and the locating recess is shaped to receive and mate with the first locator surface to align the first tool section relative to the second tool section.

8. The indexing self-aligning hardware tool of claim 1, wherein the first tool section is not coupled to the second tool section, the first die includes a die body, and the first die defines a die recess formed on the die body, the first tool section is only indirectly coupled to the second tool section only when the first component and the second component are pressed between the first tool section and the second tool section, the die body is directly coupled to the die carrier, the first tool section includes a second die and a third die, the blankholder is cylindrical to accommodate the first punch, the locating recess and the locating protrusion have mating shapes in order to help align the first tool section and the second tool section, the product feature locator is not planar, the product feature locator has a first locator surface and a second locator surface opposite the first locator surface, the locating recess mates with the first locator surface, the second locator surface defines a locator recess, and the locator recess mates with the locating protrusion of the first locator, the second locator surface is in direct contact with the locating protrusion of the first locator, and the first locator surface is in direct contact with the locating body of the second locator.

9. A locating assembly, comprising:

a first component including a product feature locator, wherein the product feature locator defines a first locator surface and a second locator surface opposite the first locator surface;

a second component in contact with the first component, wherein the first component has a planar portion to facilitate contact with the second component, the product feature locator is not flat, the product feature locator is directly coupled to the planar portion;

a first tool section including a die carrier, a first die coupled to the die carrier, and a first locator coupled to the die carrier, wherein the first tool section includes a second die and a third die, the first locator is a locating protrusion extending directly from the die carrier, the product feature locator is in direct contact with the locating protrusion, and the locating protrusion has a hexagonal cross-sectional shape to minimize slippage;

a second tool section including a support body, a blankholder directly coupled to the support body, the blankholder is in direct contact with the support body, a first punch movably disposed inside the blankholder, a fastener movably disposed inside the blankholder, a second locator coupled to the second tool section, wherein the second tool section further includes a second punch and a third punch, the second locator includes a locating body directly coupled to the support body, the second locator defines a locating recess formed in the locating body, the product feature locator is in direct contact with the locating body of the second locator; and wherein the first component and the second component are disposed between the first tool section and the second tool section, and the first punch is configured to drive the fastener through the first component and the second component and into the first die to join the first component to the second component, the first locator of the first tool section and the second locator surface of the product feature locator are configured to mate with one another to locate the second tool section relative to the second tool section, and the second locator of the second tool section and the first locator surface of the product feature locator are configured to mate with one another to locate the first tool section relative to the second tool section, and the second locator is discrete and separate from the blankholder.

10. The locating assembly of claim 9, wherein the blankholder is sized to receive the fastener, the first punch is configured to drive the fastener toward the first die, and the fastener is a self-piercing rivet.

11. The locating assembly of claim 9, wherein the first tool section is movable relative to the second tool section.

12. The locating assembly of claim 9, further comprising an assembly fixture, wherein the die carrier is supported by the assembly fixture.

13. The locating assembly of claim 12, wherein the assembly fixture has a datum hole.

14. The locating assembly of claim 9, wherein the second locator defines a locating recess, the first locator includes a locating protrusion, the first die includes a die body, the first die defines a die recess formed on the die body, and the locating recess and the locating protrusion have mating shapes.

15. The locating assembly of claim 14, wherein the locating protrusion is shaped to be received and to mate with the second locator surface, the second locator surface defines a locator recess, and the locating recess is shaped to receive and mate with the first locator surface to align the first tool section relative to the second tool section, the first tool section is only indirectly coupled to the second tool section only when the first component and the second component are pressed between the first tool section and the second tool section, the die body is directly coupled to the die carrier, the blankholder is cylindrical to accommodate the first punch, the second locator includes a locating body directly coupled to the support body, the second locator defines a locating recess formed in the locating body, the locating recess and the locating protrusion have mating shapes in order to help align the first tool section and the second tool section, the product feature locator is not planar, the locating recess mates with the first locator surface, the second locator surface defines a locator recess, and the locator recess mates with the locating protrusion of the first locator, the second locator surface is in direct contact with the locating protrusion of the first locator, and the first locator surface is in direct contact with the locating body of the second locator.

16. The locating assembly of claim 9, wherein the first tool section is not coupled to the second tool section.

* * * * *